US010627760B2

(12) United States Patent
Grinstein et al.

(10) Patent No.: US 10,627,760 B2
(45) Date of Patent: Apr. 21, 2020

(54) DETECTING CONTACT BETWEEN PRINT APPARATUS COMPONENTS AND PHOTOCONDUCTIVE SURFACES

(71) Applicant: HP Indigo B.V., Amstelveen (NL)

(72) Inventors: Meir Grinstein, Ness Ziona (IL); Asaf Shoshani, Ness Ziona (IL); Sharon Elbaz, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/349,081

(22) PCT Filed: Jan. 27, 2017

(86) PCT No.: PCT/EP2017/051845
§ 371 (c)(1),
(2) Date: May 10, 2019

(87) PCT Pub. No.: WO2018/137778
PCT Pub. Date: Aug. 2, 2018

(65) Prior Publication Data

US 2019/0346799 A1 Nov. 14, 2019

(51) Int. Cl.
*G03G 15/00* (2006.01)
*G03G 15/02* (2006.01)
*G03G 21/16* (2006.01)

(52) U.S. Cl.
CPC ..... *G03G 15/5037* (2013.01); *G03G 15/0266* (2013.01); *G03G 21/1647* (2013.01); *G03G 2221/1654* (2013.01)

(58) Field of Classification Search
CPC ..... G03G 15/0266; G03G 15/5037; G03G 21/1647; G03G 2221/1654
See application file for complete search history.

(56) References Cited

U.S. PATENT DOCUMENTS

| | | | | |
|---|---|---|---|---|
| 6,404,999 | B1 | 6/2002 | Shoji et al. | |
| 7,151,906 | B2 | 12/2006 | Chou et al. | |
| 7,366,447 | B2 * | 4/2008 | Mukai | G03G 15/025 399/168 |
| 7,481,509 | B2 | 1/2009 | Staelin et al. | |
| 8,626,038 | B2 | 1/2014 | Nelson et al. | |
| 8,991,313 | B2 | 3/2015 | Lopez et al. | |
| 2007/0025769 | A1 * | 2/2007 | Someya | G03G 15/0266 399/168 |

(Continued)

FOREIGN PATENT DOCUMENTS

WO WO-2016091335 6/2016

OTHER PUBLICATIONS

HP Indigo Digital Offset Color Technology, Jul. 4, 2016, < http://www8.hp.com/h20195/V2/getpdf.aspx/4AA1-5248ENW.pdf?ver=1.0 >.

*Primary Examiner* — Ryan D Walsh
(74) *Attorney, Agent, or Firm* — Dierker & Kavanaugh PC

(57) ABSTRACT

In an example, a method includes charging a photoconductive surface in a print apparatus and monitoring an electrical parameter associated with a proximity of a print apparatus component to the photoconductive surface. A relative spacing between the print apparatus component and the photoconductive surface may be changed and a contact between the print apparatus component and the photoconductive surface may be detected when the electrical parameter meets predetermined criteria.

8 Claims, 4 Drawing Sheets

(56) References Cited

U.S. PATENT DOCUMENTS

| | | | | |
|---|---|---|---|---|
| 2008/0267646 | A1* | 10/2008 | Oron | G03G 15/5037 399/48 |
| 2009/0311005 | A1* | 12/2009 | Nakagami | G03G 15/0216 399/115 |
| 2010/0288146 | A1 | 11/2010 | Levanon et al. | |
| 2011/0064460 | A1* | 3/2011 | Watanabe | G03G 15/0266 399/115 |
| 2011/0255884 | A1 | 10/2011 | Matsuda | |
| 2012/0308262 | A1* | 12/2012 | Gamzon-Kapeller | G03G 15/025 399/115 |
| 2013/0343771 | A1* | 12/2013 | Pines | G03G 15/0266 399/31 |
| 2014/0064751 | A1* | 3/2014 | Kuroiwa | G03G 15/55 399/31 |
| 2015/0309436 | A1 | 10/2015 | Gila et al. | |
| 2017/0052483 | A1* | 2/2017 | Takahashi | G03G 15/161 |
| 2018/0017886 | A1* | 1/2018 | Borenstain | G03G 15/50 |
| 2019/0033754 | A1* | 1/2019 | Porat | G03G 15/104 |

* cited by examiner

DETECTING CONTACT BETWEEN PRINT APPARATUS COMPONENTS AND PHOTOCONDUCTIVE SURFACES

BACKGROUND

In printing, print agents such as inks, toners, coatings and the like may be applied to a substrate. Substrates may in principle comprise any material, for example comprising paper, card, plastics, fabrics or the like.

BRIEF DESCRIPTION OF DRAWINGS

Non-limiting examples will now be described with reference to the accompanying drawings, in which.

DETAILED DESCRIPTION

Figure 1:
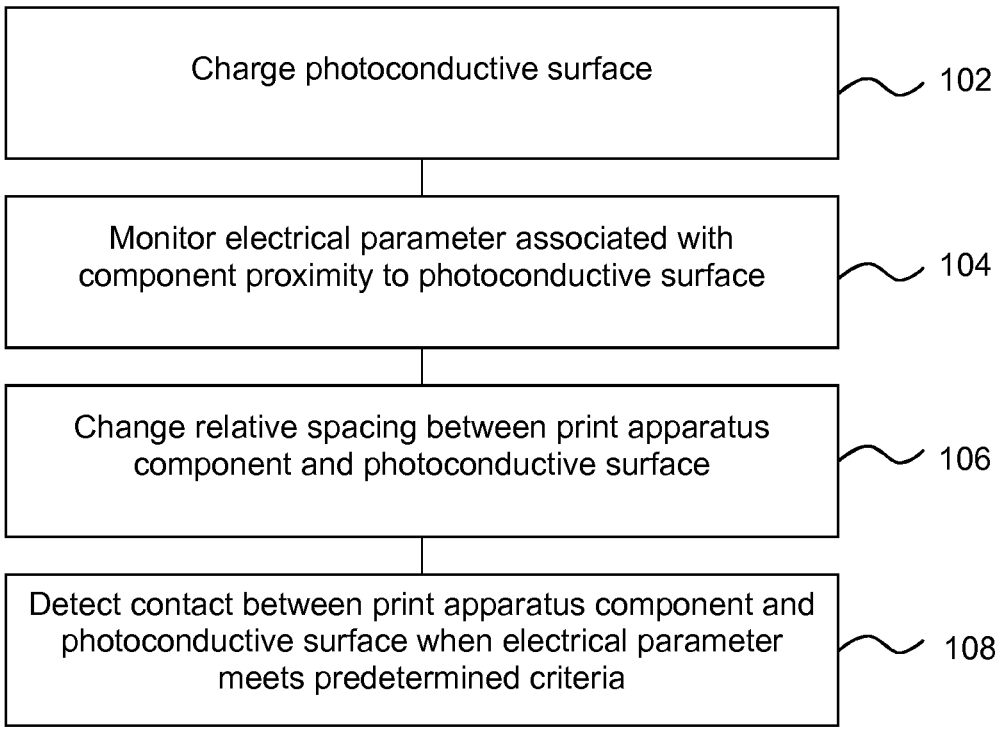
FIG. 1 is a flowchart of an example method of detecting a contact between a print apparatus component and a photoconductive surface.

In some examples of printing techniques, charged print agents, such as charged toner particles or resins, may be applied to a charged photoconductive surface. In some examples, such print agents are subsequently transferred (in some example via at least one intermediate transfer member) to a substrate.

For example, a print apparatus may comprise a Liquid Electro Photographic (LEP) print apparatus which may be used to print a print agent such as an electrostatic printing fluid or composition (which may be more generally referred to as "an electronic ink" in some examples). Such a printing fluid may comprise electrostatically charged or chargeable particles (for example, resin or toner particles which may be colored particles) dispersed in a carrier fluid. A photo charging unit may deposit a substantially uniform static charge on a photoconductive surface (which may be termed a photo imaging plate, or 'PIP'). In some examples, such a charge is transferred to the photoconductive surface via a charge transfer roller which is in contract with the photoconductive surface, although non-contact methods of charge transfer may be used. A write head, which may for example comprise at least one laser, may be used to dissipate the static charge in selected portions of the image area on the photoconductive surface to leave a latent electrostatic image.

In some examples, at certain points in the charge transfer operation, the charge transfer roller may disengage from (i.e. be moved away from) the photoconductive surface. This may for example be to avoid a 'seam' region, in which a dip or protuberance in the surface of the photoconductive surface may be seen. For example, such a seam may be seen where the photoconductive surface is a PIP formed on a drum, and the edges of a curved plate-like surface meet. The charge transfer roller may disengage at this point to avoid, for example, dropping into a dip in a seam region, as this may cause damage to the photoconductive surface at the point of reengagement, and/or a bounce which may mean at least part of the roller is not in contact with the photoconductive surface as intended, and that therefore charge is not transferred as intended.

The electrostatic printing fluid composition (generally referred to herein a 'print agent') is then transferred to the photoconductive surface from a print agent source using a print agent supply unit (which may be termed a Binary Ink Developer (BID) unit in some examples), which may present a substantially uniform film of the print agent to the photoconductive surface for example via a print agent application roller. The print agent application transfer roller may be urged towards the photoconductive surface such that is close thereto, being separated therefrom by the layer of print agent being applied (and, absent such a layer, would be in contact with the photoconductive surface). This separation may be referred to as a 'nip', and the thickness of the layer of print agent transferred to the photoconductive surface may be at least in part controlled by controlling an electric field therebetween. In some examples, at certain points, the print agent application roller may disengage from (i.e. be moved away from) the photoconductive surface. This may for example be to avoid print agent transfer to 'non-printing' regions of the photoconductive region (i.e. those regions in which an image is not formed), and/or to avoid a 'seam' region, as described above. In some examples, there may be a plurality of print agent supply units, each associated with a print agent (for example, a particular color, a coating agent, or the like).

In an example, a resin component of the print agent may be electrically charged by virtue of an appropriate potential applied to the print agent in the print agent source. The charged resin component, by virtue of an appropriate potential on the electrostatic image areas of the photoconductive surface, is attracted to a latent electrostatic image on the photoconductive surface. The print agent does not adhere to the charged areas and forms an image in print agent on the photoconductive surface in the uncharged regions. The photoconductive surface will thereby acquire a developed print agent electrostatic ink composition pattern on its surface.

In some examples, the pattern may then be transferred to an Intermediate Transfer Member (ITM), by virtue of an appropriate potential applied between the photoconductive surface and the ITM such that the charged print agent is attracted to the ITM. The ITM may for example comprise an endless loop, which may be a rubber 'blanket'. The ITM may be urged towards the photoconductive surface to be in close proximity thereto. In some examples, the ITM is biased towards the photoconductive surface such that, but for the presence of a layer of print agent on the photoconductive surface, it would be in contact with the photoconductive surface. In some examples, the ITM may disengage from the photoconductive surface in some states of the apparatus, while in other the ITM may remain in an engaged position in all states of the apparatus.

In some examples, the print agent pattern may then be dried and fused on the intermediate transfer member before being transferred to a substrate (for example, adhering to the colder surface thereof). In other examples, the photoconductive surface may carry a substrate, such that print agent is applied directly to the substrate from the print agent supply unit. In other examples, print agent may be transferred from a photoconductive surface directly to a substrate. In some examples, an image on a substrate may be built up in layers (so called 'separations') produced using different print agents. There are many other variations of print apparatus which may comprise a photoconductive surface and the methods and apparatus set out herein may be used with, or comprise, any such apparatus.

In the example described above of an LEP, any, or any combination, of a charge transfer roller of the photo charging unit, a print agent application roller and an ITM may contact the photoconductive surface in performing its respective function. In some examples, at least one of such apparatus may be caused to engage and/or disengage from the photoconductive surface under the control of positioning apparatus, in some examples, two spaced positioning apparatus, which may act on each end of a relatively elongate roller or component part of the component.

In other examples, other print apparatus components, such as cleaning apparatus and the like, may selective engage with the photoconductive surface.

FIG. 1 is an example of a method, which may be a method for controlling and/or calibrating a print apparatus. Block 102 comprises charging a photoconductive surface in a print apparatus. As noted above, charging may be carried out in a contact manner (for example, using a charging roller) or non-contact manner.

Block 104 comprises monitoring an electrical parameter associated with a proximity of a print apparatus component to the photoconductive surface. For example, the print apparatus component may comprise a component which is intended, in use of the print apparatus for printing, to be in contact with the photo conductive surface for at least part of a print operation, or to have a predetermined relative spacing therefrom. In some examples, the electrical parameter is a parameter which may be affected by the proximity of the charged photoconductive surface. In other words, the electrical parameter is a parameter which may change based on the proximity (i.e. closeness) of and/or contact with the charged photoconductive surface, i.e. there is at least some feedback between the charged photoconductive surface and the monitored electrical parameter, wherein the feedback may be indicative of contact and/or proximity. Viewed another way, the electrical parameter may be a parameter relating to a condition which is induced by the proximity and/or contact between the component and the photoconductive surface. 'Proximity' may be any distance which is small enough that there is a detectable effect due to presence of the charged photoconductive surface on the electrical parameter. The proximity of the print apparatus component (i.e. the 'closeness' of the print apparatus component to the photoconductive surface) may be the proximity of a part, of example, the closest part or surface, or part of a surface, of the print apparatus component to the photoconductive surface. In some examples the proximity of the component may be categorises as in contact or not in contact.

In some examples, the print apparatus component may comprise a photo charging unit, a print agent supply unit or an ITM. As noted above, each of such components may, in some examples of print apparatus, engage with the photoconductive surface for at least part of a print operation, and in some examples, may disengage for another part of the print operation.

In some examples, the print apparatus component is a component which, in a standard print operation, and in at least a part thereof, carries a charge. For example, the photo charging unit may comprise a charged charge transfer roller. The print agent application roller of the print agent supply unit may also carry a charge to provide for an appropriate potential between the roller and the photoconductive surface to provide print agent transfer. The ITM may be charged to assist in transferring an image from the photoconductive surface to the ITM. In some examples, the method is carried out while the component is in a discharged, or un-charged, state. However, as noted in block 102, the photoconductive surface is in a charged state. In some examples, the method is carried out while the component is in charged state, for example to limit a current flow between the component and the photoconductive surface. Any such charge may be selected so as to provide a reasonable level of feedback when contact is made.

The electrical parameter which is monitored may for example be an electrical parameter, such as a current value or a voltage value, of the component. For example, a voltage or a current of a print agent supply unit may be monitored. The print agent supply unit may comprise a power supply, and the power supply may be operable to supply power to the unit. The voltage and current within the print agent supply unit such as the print agent supply unit power supply may be monitored. In another example, a voltage/current of the photoconductive surface may be monitored, for example using an electrometer or the like which is in contact with the surface. In such an example, the parameter is associated with the component proximity in that the closeness or contact between the component and the photoconductive surface changes the value of the parameter, as set out below.

Block 106 comprises changing a relative spacing between the print apparatus component and the photoconductive surface. This may for example comprise driving at least one positioning apparatus, which may comprise motors, positioning arms, or the like. The position of the print apparatus component and/or the photoconductive surface may be changed as a whole, or in part. For example, the relative spacing may be determined using the distance of least separation between at least part of the print apparatus component and the photoconductive surface, and/or changing the relative spacing may comprise changing the position of part of the print apparatus component. In some examples, the part may be a roller or the like, which may be intended to contact the photoconductive surface in at least some operational states.

Block 108 comprises detecting a contact between the print apparatus component and the photoconductive surface when the electrical parameter meets predetermined criteria. For example, a contact may be detected when a monitored voltage value and/or a monitored current value of the print apparatus component is above a threshold. Such an effect may be seen as the photoconductive surface is at a higher voltage than the print apparatus component. A contact between the two completes an electrical circuit, allowing a current to flow and charging at least the point of contact (for example, a roller or the like), causing the photoconductive surface to discharge and a voltage to develop within the print apparatus component. In some examples, a voltage may be develop as the photoconductive surface discharges to the component. In such cases, determining the current may generally be quicker as there is no need to wait for the photoconductive surface capacitance to discharge. However determining the voltage may be more straightforward.

Determining the position in which a component makes contact with the photoconductive surface may have a number of uses within the apparatus. For example, it may reduce unnecessary strain being placed on components. As noted above, some components may engage and disengage from the photoconductive surface. In some examples, two print operations may be carried out on different portions of a photoconductive surface. For example, considering a drum bearing a photo imaging plate, a first image may be formed on a first half of the drum and a second image may be formed of the opposed side of the drum. The point of engagement on each side of the drum should be synchronised to prevent misalignment in printed images. In order to carry out such processes quickly (for example, so as not to slow print operation) and precisely (for example, so as to avoid bouncing or engagement in a manner which may damage the apparatus and/or result in print defects, and/or misalignment between images formed on different portions of the photoconductive surface), the movement may be kept small, in which case it is useful to know the contact position precisely.

Some methods of determining a point of contact between a print agent supply unit and a photoconductive surface have comprised printing a bar to a substrate: the bar appears where contact is made, and is absent where not. This printed image may be manually reviewed and interpreted by a skilled user, who may then make adjustments to the apparatus. By contrast, the method of FIG. 1 may be carried out automatically without requiring interpretation by a skilled user, and without consuming print agent or substrate in calibration.

In some examples, the method may be carried out such that any interaction of the component and the photoconductive surface which occurs in a seam region is discounted. As such a region may represent a dip or a ridge, the electrical parameter may be anomalous in the seam region.

Figure 2:
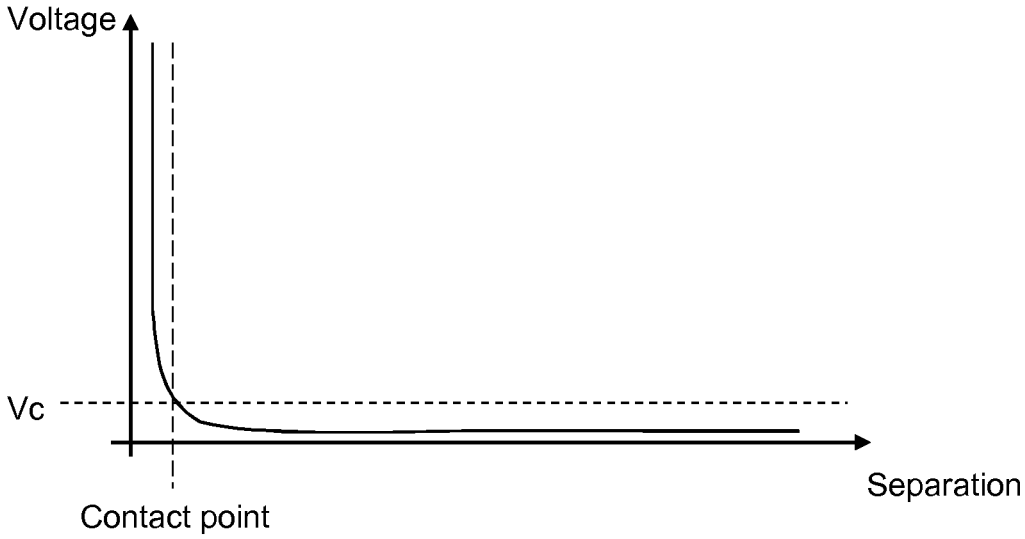
FIG. 2 a schematic representation of a graph showing an example of how an electrical parameter may vary with separation between a print apparatus component and the photoconductive surface.

FIG. 2 shows an example of a voltage within a print agent supply unit in an example of the method of FIG. 1. This graph shows how a voltage of the power supply of an application roller of a print agent supply unit changes with separation between the roller and the photoconductive surface (although similar results may be seen for a power supply of a cleaner unit). The values in the graph may be average values which are acquired over a portion (for example a small portion, of less than half a cycle) of the rotation of a photoconductive surface.

Once a spacing between the print agent application roller of the print agent supply unit and the photoconductive surface become small, the voltage within the print agent supply unit (which is generated by a power supply unit thereof) increases. When a 'contact' event occurs (i.e. the application roller touches the photoconductive surface), the voltage (at that point, the contact voltage, or Vc) is changing rapidly with changes in separation. In some examples a 'contact' event may be recorded when the voltage rises above a threshold, for example around 10V in this example. This allows for some tolerance in the measurement process. The threshold may be associated with a 'just touch' event, i.e. the point of first contact at low pressure. Further reducing the spacing may result in an increase in voltage as shown for example as more of the roller (which may not, at least initially, be exactly coaxial with the photoconductive surfaces) contacts the photoconductive surface and/or the contact therebetween becomes more complete.

In other examples, a contact may be detected when an electrical parameter falls below a threshold.

Figure 3:
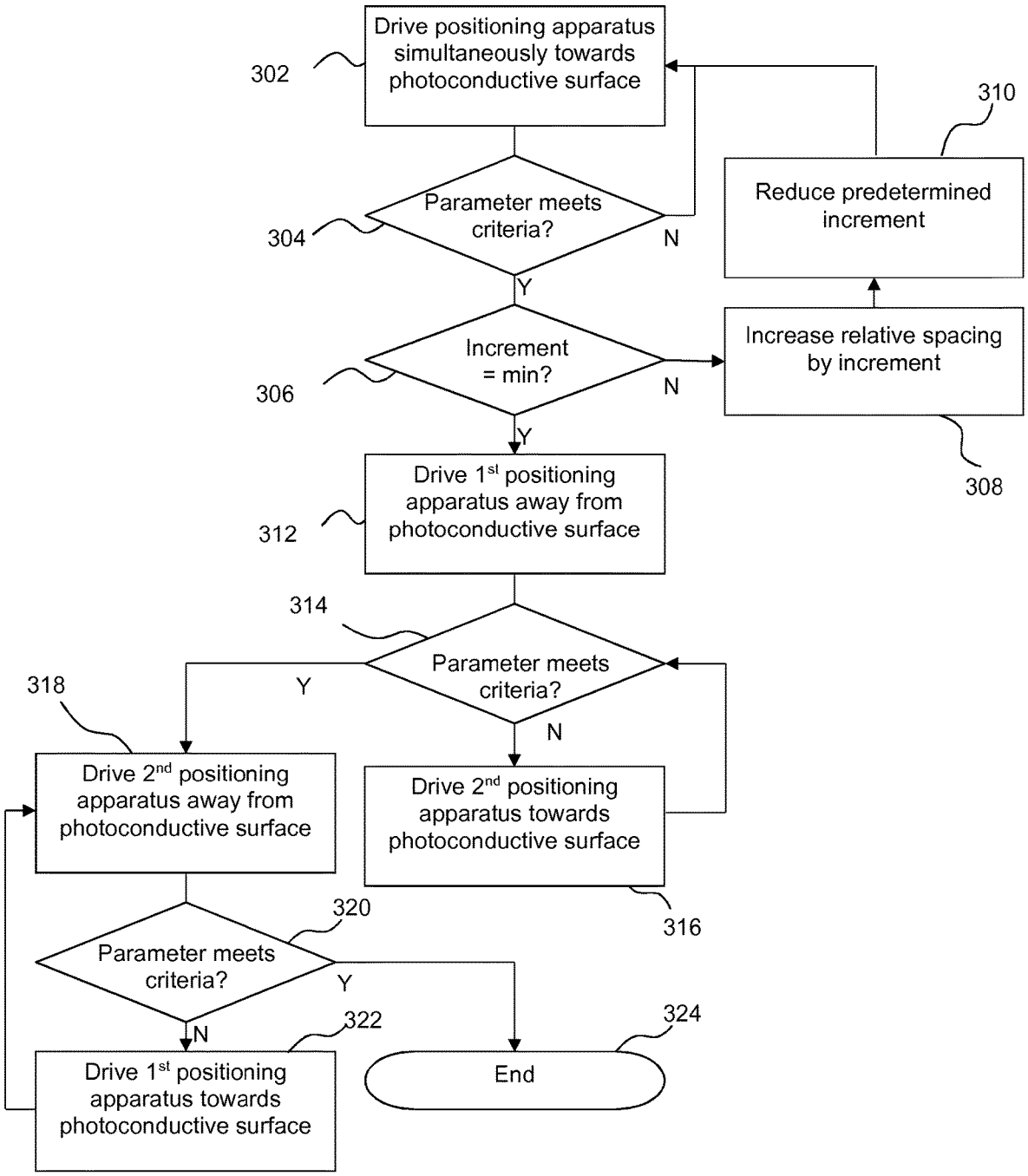
FIG. 3 is a flowchart of another example method of detecting a contact between a print apparatus component and a photoconductive surface.

FIG. 3 is another example, which may be a method of calibrating a print apparatus, for example a method of calibrating the position of at least one print apparatus component relative to a photoconductive surface. The method may for example be a method of carrying out blocks 106 and 108 of FIG. 1.

Block 302 comprises reducing a relative spacing between a print apparatus component and a photoconductive surface by a predetermined increment by driving two separated positioning apparatus simultaneously. For example, the positioning apparatus may be operable to control the position of two ends of a roller (which may for example be charge transfer roller, a print agent application roller, a cleaner roller or a roller supporting an ITM). In block 304, it is determined if the electrical parameter meets the predetermined criteria. If not, the method iterates back to block 302, and the relative spacing is reduced again by the predetermined increment. If however it is determined that the electrical parameter does meet the predetermined criteria, the method continues in block 306 by determining if the predetermined increment is a minimum available predetermined increment. If not, the method comprises increasing the relative spacing by the increment in block 308 and, in block 310, reducing the predetermined increment, for example to a fraction of the previous increment, such as half thereof.

The method then returns to block 302, with the predetermined increment being a smaller increment, and the process repeats, possibly further reducing the size of the increment until it is determined in block 306 that the predetermined increment is a minimum available increment. In that case, the method continues, in block 312, by driving two separated positioning apparatus separately, such that a first of the two positioning apparatus is driven to move at least part of the print apparatus component away from the photoconductive surface by a predetermined spacing. This spacing may be relatively large compared to the increments used in block 302, for example in the order of 10 of the coarsest increment used.

It is determined, in block 314, if the electrical parameter meets the predetermined criteria. If so, in some examples, the second positioning apparatus may be driven to remove the contact between the print apparatus component and the photoconductive surface. If/when the electrical parameter does not meet the predetermined criteria, in block 316 the second of two positioning apparatus is driven to move at least part of the print apparatus component towards the photoconductive surface by a predetermined spacing, which may be one of the increments applied in block 302, for example, the smallest increment, and the method returns to block 314.

The process is repeated until it is determined, in block 314, that the electrical parameter meets the predetermined criteria. In some examples (for example, if the smallest increment is not used initially) following a determination that the parameter meets the criteria, the spacing may be increased and a smaller increment used as described in relation to blocks 306-310. In some examples, the position of the apparatus arrived at in block 306 is then restored.

This method is then repeated, with the roles of the positioning apparatus being reversed, i.e. the second of the two positioning apparatus is driven to move part of the print apparatus component away from the photoconductive surface by a predetermined spacing in block 318 and it is determined, in block 320, if the electrical parameter meets the predetermined criteria (in which case the first of the two positioning apparatus may be driven to move part of the print apparatus component away from the photoconductive surface). If/when the electrical parameter does not meet the predetermined criteria, in block 322 the first of two positioning apparatus is driven to move part of the print apparatus component towards the photoconductive surface by a predetermined spacing, which may be one of the increments applied in block 302, for example, the smallest increment, and the method returns to block 318. This is repeated until it is determined, in block 320, that the electrical parameter meets the predetermined criteria, in which case the method terminates (block 324). In some examples (for example, if the smallest increment is not used initially) following a determination that the parameter meets the criteria, the spacing may be increased and a smaller increment used as described in relation to blocks 306-310.

This method allows for a balance to be determined between two positioning devices. For example, it may be the case that a roller is mounted and the position relative to the photoconductive surface is controlled by a positioning apparatus provided at each end thereof. However, the action of each positioning device may not be exactly balanced, and/or the axis of the roller may not be parallel to the photoconductive surface. Moreover, a degree of misalignment and/or unbalance may differ between print apparatus, even print apparatus of the same type, due to differences in installation, assembly, manufacture and the like. This method therefore allows a first touch to be identified by controlling the positioning apparatus together, and then corrects for any difference/misalignment by controlling each positioning apparatus separately, detecting a first touch point at either end of the roller.

The position of the first positioning device when a positive determination was made in block 320 and the position of the second positioning device when a positive determination was made in block 314 represent a 'contact' position of each end. In each case, the determination of contact for one end of the roller is made while the other positioning device is positioned so as to remove the contact between the other end of the roller and the photoconductive surface. Arranging both positioning device in such positions will therefore result in a light, or 'just touch' contact with the photoconductive surface along the full length of the roller. The position of the positioning apparatus when contact is made may be used to determine the position/configuration of the print apparatus component to be adopted in use in use, for example such that the point of contact with the photoconductive surface, and/or an offset therefrom, may be found and applied in use of the apparatus to carry out print operations.

Figure 4:
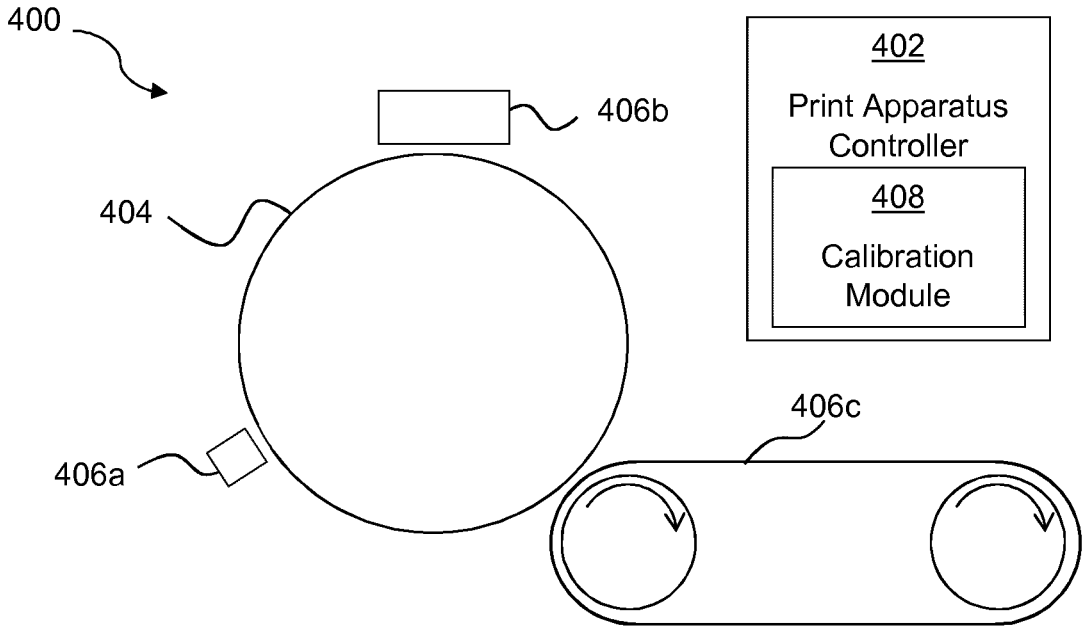
FIG. 4 is an example print apparatus.

FIG. 4 is an example of a print apparatus 400 comprising a print apparatus controller 402, a photoconductive surface 404 (in this example, in the form a drum having a PIP wrapped around the surface thereof) and at least one print apparatus component 406. The print apparatus 400 of this example comprises a plurality of print apparatus components 406, in this example print agent application unit 406*a*, a photo charging unit 406*b* and an Intermediate transfer member (ITM) 406*c*, which is shown supported by two rollers, although in other examples this may comprise a drum.

The print apparatus controller 402 is to selectively cause a print apparatus component 406 to contact the photoconductive surface 404. For example, at least one of the print apparatus components 406 may comprise a roller which is moved towards or away from the photoconductive surface 404.

The print apparatus controller 402 comprises a calibration module 408. The calibration module 408 is to monitor an electrical condition of the print apparatus 406 indicative of a relative spacing between the print apparatus component 406 and the photoconductive surface 404 when the photoconductive surface 404 is charged. For example, the electrical condition may be a condition induced in the component 406 by the charged photoconductive surface 404, or may be indicative of a reduction of charge in the photoconductive surface 404. In some examples, the condition may be indicative that a spacing (as compared to no spacing) exists. The calibration module 408 is further to change the relative spacing between the print apparatus component 406 and the photoconductive surface 404 until a predetermined electrical condition is detected. The predetermined electrical condition may be a condition indicative of contact between at least part of the print apparatus component 406 and the photoconductive surface 404.

In some example, the print apparatus controller 402 may carry out the method of FIG. 1 or FIG. 3.

Figure 5:
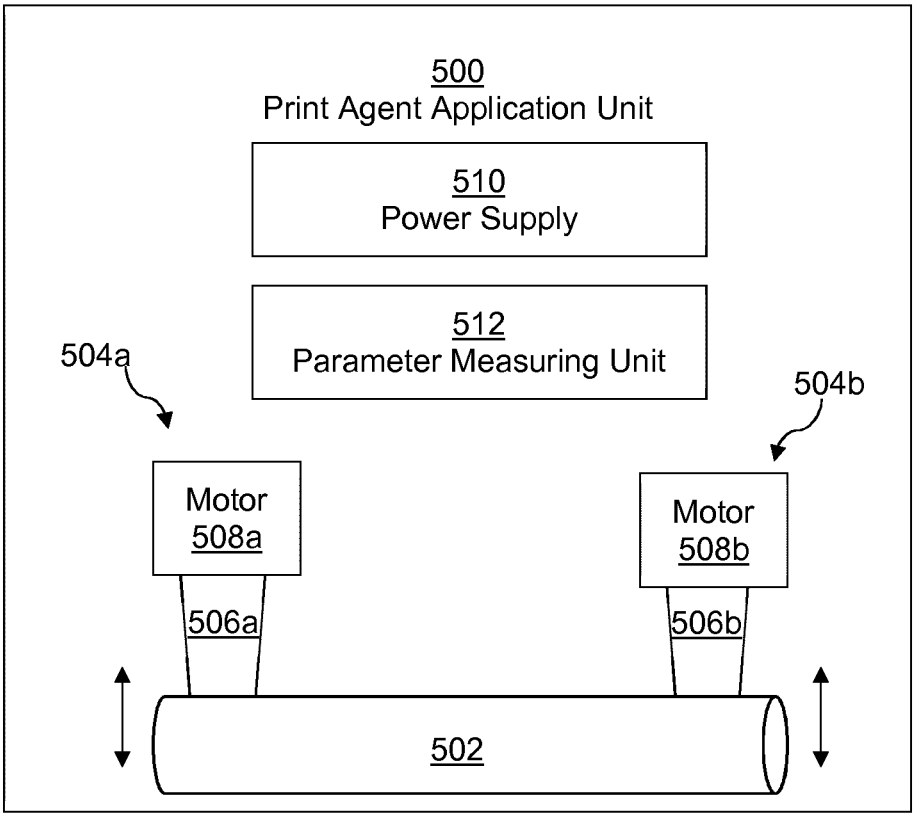
FIG. 5 is an example print apparatus component.

FIG. 5 is an example of a print apparatus component 406, which may be used as part of the apparatus of FIG. 4 and in this example comprises a print agent application unit 500 which comprises a print agent supply roller 502. The roller 502 is mounted on two laterally spaced positioning apparatus 504*a*, 504*b*, which in this example comprise arms 506*a*, 506*b* driven by a pair of laterally spaced drive motors 508*a*, 508*b*, and which are mounted towards either end of the roller 502. In this example, the calibration module 408 may drive the two laterally spaced positioning apparatus 504*a*, 504*b*. In some examples, the calibration module 508 may drive the two positioning apparatus 504*a*, 504*b* simultaneously until the predetermined electrical condition is detected, and subsequently drive each positioning apparatus 504*a*, 504*b* individually until the predetermined electrical condition is detected, for example as described in relation to FIG. 3 above. In some examples, the motors 508 may be servo motors. The motors 508 may for example be controlled using Proportional-Integral-derivative controller (PID controller) with a control loop feedback mechanism, which receives feedback from an encoder, for example a rotary controller.

The print agent application unit 500 further comprises a power supply 510 and a parameter measuring unit 512. The power supply 510 provides power to the print agent application unit 500 (for example via an internal power supply unit or from an external power supply unit) and the parameter measuring unit 512, which may for example comprise a voltmeter, an ammeter or the like, monitors at least one electric parameter which relates to an electrical condition induced or caused by a close, and/or touching, charged photoconductive surface 404. In some examples, this may be a current value or a voltage value of the power supply 510.

The print agent application unit 500 may further comprise other apparatus, such as a print agent source, a means of charging print agent, pumps and/or other print agent transfer mechanisms, and the like.

While the Figure shows a print agent application unit 500, other print apparatus components may comprise positioning apparatus, which may in turn comprise laterally spaced positioning apparatus, and/or which may be used to position the component as a whole, or a part thereof, such as a roller.

Figure 6:
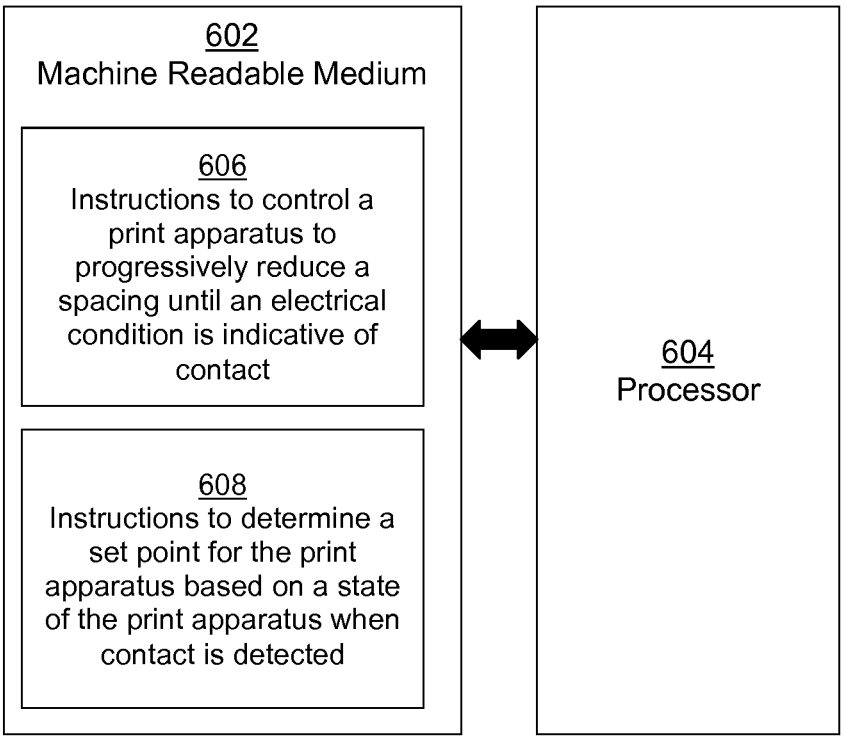
FIG. 6 is an example of a machine readable medium in association with a processor.

FIG. 6 is an example of a tangible (non-transitory) machine readable medium 602 in association with a processor 604. The machine readable medium 602 comprises instructions 606 which, when executed by the processor 604, cause the processor 604 to control a print apparatus to progressively reduce a spacing between a print apparatus component and a photoconductive surface of the print apparatus until an electrical condition of the print apparatus component is indicative of contact between the print apparatus component and the photoconductive surface. The machine readable medium 602 further comprises instructions 608, when executed by the processor 604, further cause the processor 604 to determine a set point for the print apparatus based on a state of the print apparatus when contact is detected. This set point may be utilised in subsequent print operations.

In some examples, the instructions 608, when executed by the processor 604, further cause the processor 604 to determine a set point which is indicative of a condition of a pair, or for each, of the laterally spaced drive motors. The condition may for example be a rotary encoder position. In some examples, the set point for one of the drive motors is determined while the other of the drive motors is controlled so as to cause a non-contact state in at least part of the component.

In some examples, the machine readable medium 602 comprises instructions which, when executed by the processor 604, cause the processor 604 to carry out the method of FIG. 1 and/or FIG. 3. In some examples, the machine readable medium 602 comprises instructions which, when executed by the processor 604, cause the processor 604 to act as the print apparatus controller 402 and/or as the calibration module 408.

Aspects of some examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that at least one flow in the flow charts, as well as combinations of the flows in the flow charts can be realized by machine readable instructions.

The machine readable instructions may, for example, be executed by a general purpose computer, a special purpose computer, an embedded processor or processors of other programmable data processing devices to realize the functions described in the description and diagrams, and which may for example comprise at least part of the print apparatus controller 402 or the calibration module 408. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims and/or other dependent claim(s).

The invention claimed is:

1. A method comprising:

charging a photoconductive surface in a print apparatus;

monitoring an electrical parameter associated with a proximity of a print apparatus component to the photoconductive surface;

progressively reducing a relative spacing between the print apparatus component and the photoconductive surface in increments until the electrical parameter meets a predetermined criteria; then increasing the relative spacing; and reducing the relative spacing progressively in smaller increments until the electrical parameter meets the predetermined criteria.

2. A method according to claim 1 in which the method is carried out iteratively until the relative spacing is reduced by a minimum available increment.

3. A method according to claim 1 wherein monitoring the electrical parameter comprises monitoring a current value or a voltage value.

4. A print apparatus comprising a print apparatus controller, a photoconductive surface and a print apparatus component, wherein:

the print apparatus controller is to selectively cause the print apparatus component to contact the photoconductive surface and the print apparatus controller comprises a calibration module;

wherein the calibration module is to monitor an electrical condition of the print apparatus indicative of a relative spacing between the print apparatus component and the photoconductive surface when the photoconductive surface is charged and to reduce a relative spacing between the print apparatus component and the photoconductive surface in increments until a predetermined electrical condition is detected; then increase the relative spacing; and reduce the relative spacing progressively in smaller increments until the electrical parameter meets the predetermined criteria.

5. A print apparatus according to claim 4 in which the print apparatus component comprises a power supply, a parameter measuring unit and a roller which, in use of the print apparatus, contacts the photoconductive surface.

6. A tangible machine readable medium comprising instructions which, when executed by a processor, cause the processor to:

control a print apparatus to:

progressively reduce a spacing between a print apparatus component and a photoconductive surface of the print apparatus in increments until an electrical condition of the print apparatus component is indicative of contact between the print apparatus component and the photoconductive surface; then increase the relative spacing; and reduce the relative spacing progressively in smaller increments until the electrical parameter meets the predetermined criteria; and determine a set point for the print apparatus based on a state of the print apparatus when contact is detected.

7. A tangible machine readable medium according to claim 6 comprising instructions to determine a set point which is indicative of a condition of a pair of laterally spaced drive motors.

8. A tangible machine readable medium according to claim 7 comprising instructions to determine a set point which is indicative of a condition of each of the laterally spaced drive motors.

* * * * *